US007419032B2

(12) United States Patent
Yamakawa

(10) Patent No.: US 7,419,032 B2
(45) Date of Patent: Sep. 2, 2008

(54) ELEVATOR MONITORING TERMINAL AND ELEVATOR MONITORING APPARATUS WITH MULTIPLE DISPLAY SCREENS DISPLAYING OPERATIONAL DATA, IN-CAR IMAGE DATA AND COMMUNICATION REQUEST DATA

(75) Inventor: Shigeki Yamakawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 557 days.

(21) Appl. No.: 10/541,768

(22) PCT Filed: Mar. 1, 2004

(86) PCT No.: PCT/JP2004/002473

§ 371 (c)(1),
(2), (4) Date: Jul. 8, 2005

(87) PCT Pub. No.: WO2005/082764

PCT Pub. Date: Sep. 9, 2005

(65) Prior Publication Data

US 2006/0144645 A1 Jul. 6, 2006

(51) Int. Cl.
*B66B 1/28* (2006.01)

(52) U.S. Cl. ..... 187/247; 187/391

(58) Field of Classification Search ..... 187/247, 187/248, 391–396, 313, 316, 317, 413
See application file for complete search history.

(56) References Cited

U.S. PATENT DOCUMENTS

| | | | | | |
|---|---|---|---|---|---|
| 3,973,648 | A | * | 8/1976 | Hummert et al. | 187/393 |
| 4,418,795 | A | * | 12/1983 | Trosky et al. | 187/391 |
| 4,697,243 | A | * | 9/1987 | Moore et al. | 706/59 |
| 4,930,604 | A | * | 6/1990 | Schienda et al. | 187/393 |
| 5,131,508 | A | * | 7/1992 | Suzuki | 187/380 |
| 5,736,694 | A | * | 4/1998 | Ketoviita | 187/391 |
| 6,304,257 | B1 | * | 10/2001 | Viskari | 715/764 |

FOREIGN PATENT DOCUMENTS

| | | | | |
|---|---|---|---|---|
| JP | 05139642 | A | * | 6/1993 |
| JP | 06316387 | A | * | 11/1994 |
| JP | 08-151176 | | | 6/1996 |
| JP | 11-228046 | | | 8/1999 |
| JP | 11228046 | A | * | 8/1999 |
| JP | 2002-241060 | | | 8/2002 |
| JP | 2003-212447 | | | 7/2003 |
| JP | 2003-300679 | | | 10/2003 |
| JP | 2004-1893358 | | | 7/2004 |
| JP | 2003-81545 | | | 3/2005 |

* cited by examiner

*Primary Examiner*—Jonathan Salata
(74) *Attorney, Agent, or Firm*—Leydig, Voit & Mayer, Ltd.

(57) ABSTRACT

An elevator monitoring terminal includes a storage unit and a processing unit. The storage unit stores screen-displayed data including monitor-related screens related to an elevator monitoring operation, and the processing unit displays the monitor-related screens in the screen-displayed data read from the storage unit on a display unit.

4 Claims, 6 Drawing Sheets

ELEVATOR MONITORING TERMINAL AND ELEVATOR MONITORING APPARATUS WITH MULTIPLE DISPLAY SCREENS DISPLAYING OPERATIONAL DATA, IN-CAR IMAGE DATA AND COMMUNICATION REQUEST DATA

TECHNICAL FIELD

The present invention relates to an elevator monitoring terminal and elevator monitoring apparatus for executing processings related to an elevator monitoring operation.

BACKGROUND ART

Conventional elevator remote monitoring systems are configured to execute various processings related to an elevator monitoring operation by use of a maintenance server and various terminals (e.g., monitor station) as disclosed in JP 2003-212447 A, for example.

However, display screens for various processings related to an elevator monitoring operation are not displayed concurrently on a terminal, which leads to a problem in that the elevator monitoring operation cannot be efficiently carried out.

The present invention has been made to solve the above-described problem, and it is therefore an object of the present invention to provide an elevator monitoring terminal and elevator monitoring apparatus which enable an efficient elevator monitoring operation.

DISCLOSURE OF THE INVENTION

According to one aspect of the present invention, there is provided an elevator monitoring terminal includes a storage unit and a processing unit, the storage unit storing screen-displayed data including a plurality of monitor-related screens related to an elevator monitoring operation. The processing unit displays the plurality of monitor-related screens in the screen-displayed data read from the storage unit on a display unit.

According to another aspect of the present invention, there is provided an elevator monitoring apparatus includes a storage unit and a processing unit, the storage unit storing screen-displayed data including a plurality of monitor-related screens related to an elevator monitoring operation. The processing unit selectively incorporates any one of the plurality of monitor-related screens into the screen-displayed data and sends the screen-displayed data to a monitoring terminal via a communication network in response to an instruction from an external device.

BEST MODE FOR CARRYING OUT THE INVENTION

Hereinafter, first and second embodiments of the present invention will be described with reference to the accompanying drawings.

FIRST EMBODIMENT

Figure 1:
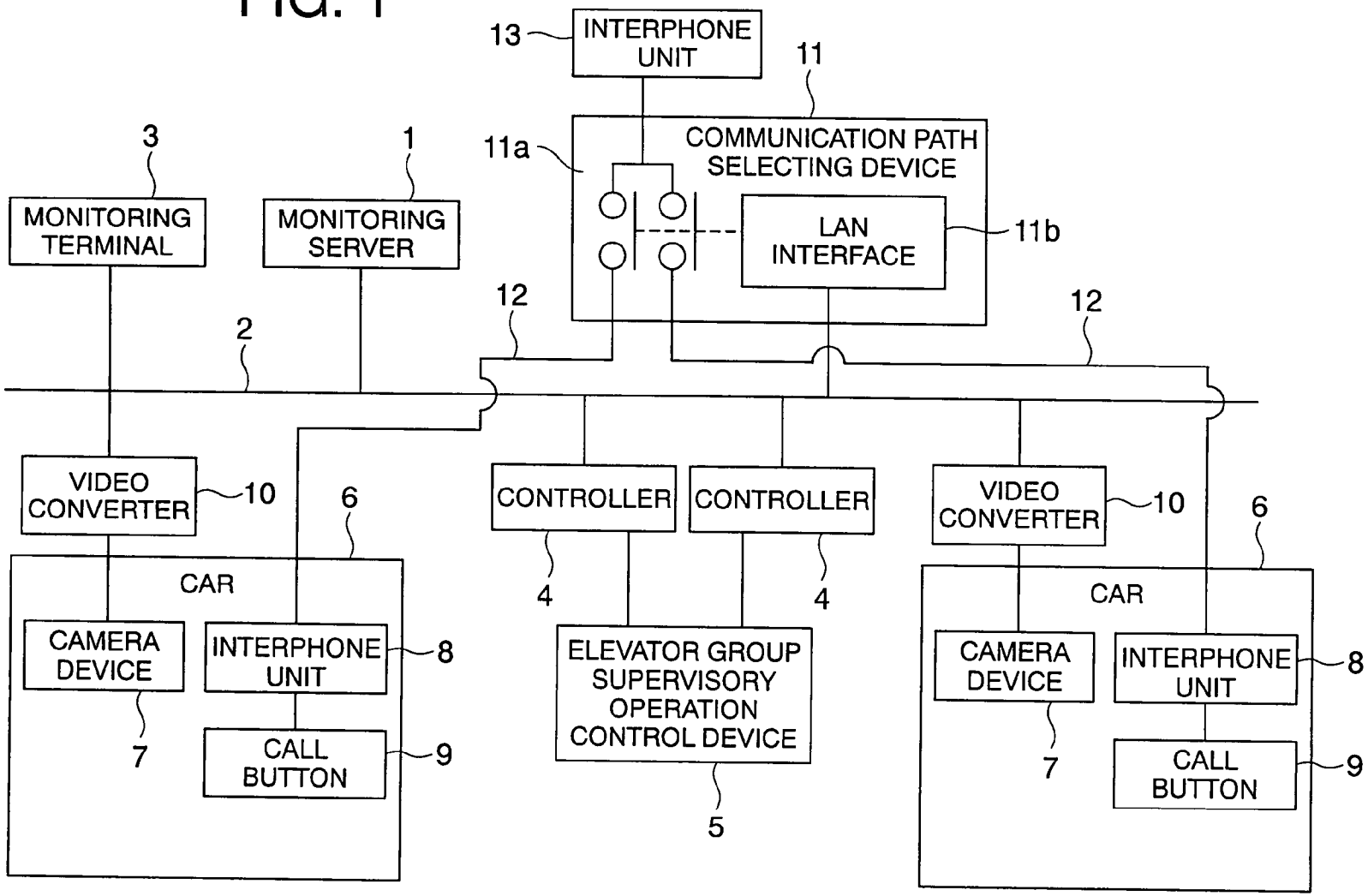
FIG. 1 is a diagram showing a configuration of an elevator monitoring system according to a first embodiment of the present invention.

FIG. 1 is a diagram showing a configuration of an elevator monitoring system according to the first embodiment of the present invention.

In FIG. 1, a monitoring server (monitoring apparatus) 1 for monitoring an elevator operation is connected with a monitoring terminal 3 via an Ethernet (communication network) 2. The monitoring server 1 and the monitoring terminal 3 are installed in a monitor room. In this connection, the monitor room refers to anyplace where an observer or other person monitors an elevator operation while viewing a screen displayed on the monitoring terminal 3 with no particular limitation.

The monitoring server 1 provides services for monitoring operations of plural elevators in response to a request from the monitoring terminal 3. Herein, the monitoring server provides three services: a service for checking an operation of an elevator; a service for checking an in-car condition; and a service for connecting lines between a car and the monitor room.

The monitoring server 1 is connected to plural controllers 4 and an elevator group supervisory operation control device 5. Each controller 4 controls operations of cars 6 of first and second elevators corresponding thereto under the supervision of the elevator group supervisory operation control device 5.

Provided in each car 6 of the first and second elevators are a camera device 7, an interphone unit 8, and a call button 9. The camera device 7 continuously outputs image data d1 indicative of the condition in the car 6 to the monitoring server 1 via a video converter 10 and the Ethernet 2. The video converter 10 converts a video signal from the camera device 7 into a signal conforming to specifications of the Ethernet 2.

The interphone unit 8 is an interphone cordless handset (including a microphone speaker), for example, which is connected with an interphone unit 13 through a communication line 12 by way of a communication path selecting device 11. The interphone unit 13 is an interphone base unit, for example, which is set in the monitor room.

The communication path selecting device 11 includes a relay circuit 11*a* and a LAN (Local Area Network) interface (including a microcomputer) 11*b*.

The relay circuit 11*a* connects lines between the interphone units 8 and 13 in response to an instruction from the LAN interface 11*b*. That is, the relay circuit 11*a* connects lines between the car 6 and the monitor room.

The call button 9 is used for calling an observer or the like, and is depressed by a passenger in the car 6 in emergencies, for example. The call button 9 being depressed, the communication path selecting device 11 informs the monitoring server 1 to that effect via the Ethernet 2.

The monitoring server 1 and the monitoring terminal 3 will be described in detail in turn.

Figure 2:
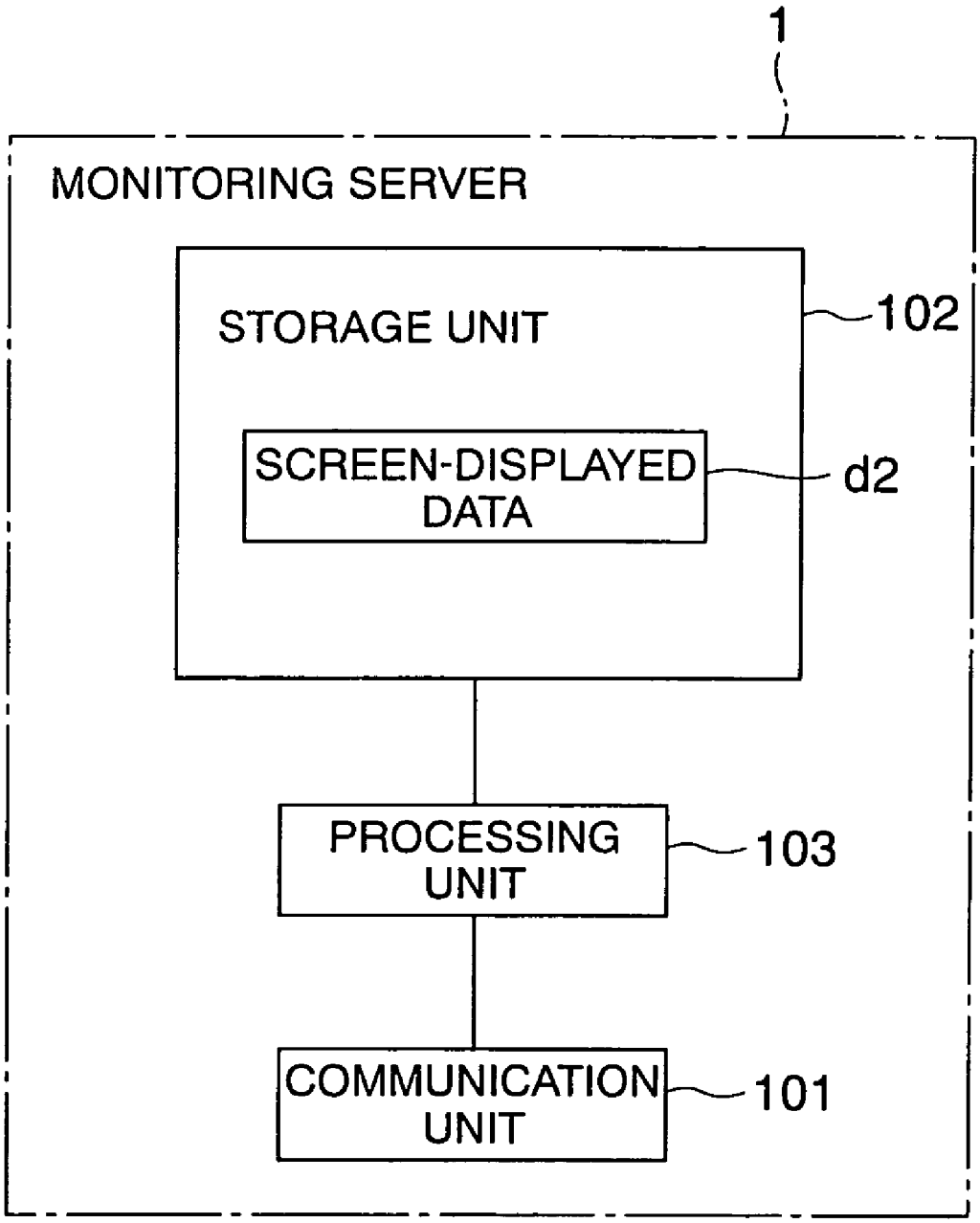
FIG. 2 is a block diagram showing a configuration of a monitoring server of FIG. 1.

FIG. 2 is a block diagram showing a configuration of the monitoring server 1. In FIG. 2, the monitoring server 1 includes a communication unit 101, a storage unit 102, and a processing unit 103. The communication unit 101 is an input/output interface, for example. The monitoring server of FIG. 2 corresponds to a web server, for example.

The storage unit 102 is, for example, a memory or hard disk. The storage unit 102 stores screen-displayed data d2. The screen-displayed data d2 is data composing a window displayed on the monitoring terminal 3 in the visually segmented form. The screen-displayed data d2 includes plural monitor-related screens.

Each monitor-related screen constitutes the window, and relates to an elevator monitoring operation. Given here as the monitor-related screen are three screens: a display screen S1 of the image data d1; a display screen S2 of monitoring information d3; and a connection request screen S3. The screen-displayed data d2 includes any of these three screens in response to an instruction from the monitoring terminal 3 or communication path selecting device 11. Note that the monitoring terminal 3 and the communication path selecting device 11 are referred to as external devices.

The monitoring information d3 is data indicative of an operation of each of the first and second elevators, which is regularly updated based on the last control operation made by the elevator group supervisory operation control device 5. The monitoring information d3 includes, for example, information about which floor the car 6 of each elevator is on.

The image data d1 is constantly updated in accordance with current conditions in the car 6 taken by each camera device 7.

The connection request screen S3 is used for notifying the observer or the like that a passenger in the car 6 depresses the call button 9 for calling the interphone unit 13. In this example, a button indicating "CALL" is displayed on the connection request screen S3.

The processing unit 103 is a CPU, for example. The processing unit 103 operates in accordance with a server program such as a web server program in the storage unit 102 or a communication program such as SOKET.

Figure 3:
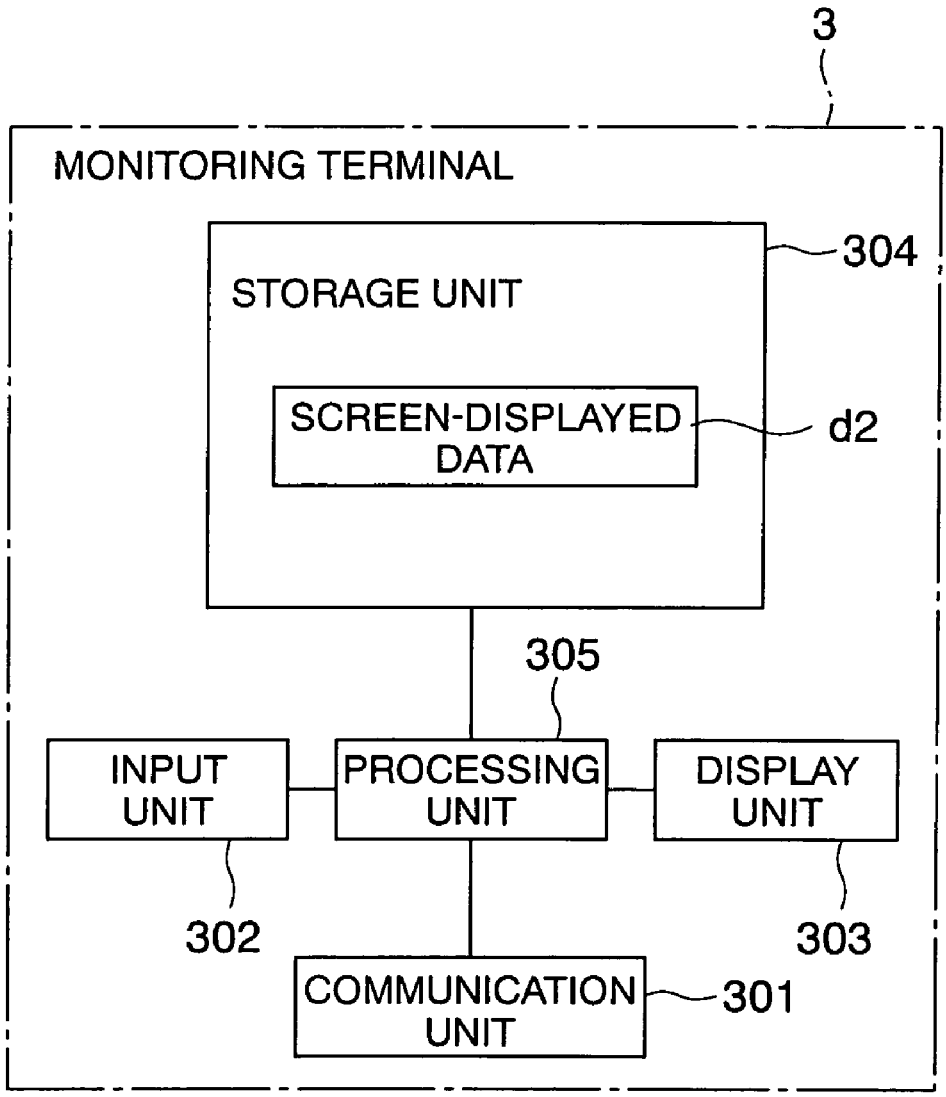
FIG. 3 is a block diagram showing a configuration of a monitoring terminal of FIG. 1.

FIG. 3 is a block diagram showing a configuration of the monitoring terminal 3. In FIG. 3, the monitoring terminal 3 includes a communication unit 301, an input unit 302, a display unit 303, a storage unit 304, and a processing unit 305 for controlling each unit. For example, a personal computer or the like corresponds to the monitoring terminal 3 of FIG. 3.

The communication unit 301 is an input/output interface, for example. The input unit 302 is a keyboard or mouse, for example. The display unit 303 is a display device, for example.

The storage unit 304 is a memory or hard disk, for example. The storage unit 304 stores the screen-displayed data d2.

The processing unit 305 is, for example, a CPU. The processing unit 305 operates in accordance with a program, for example, a browser in the storage unit 304 or JAVA®.

Figure 4:
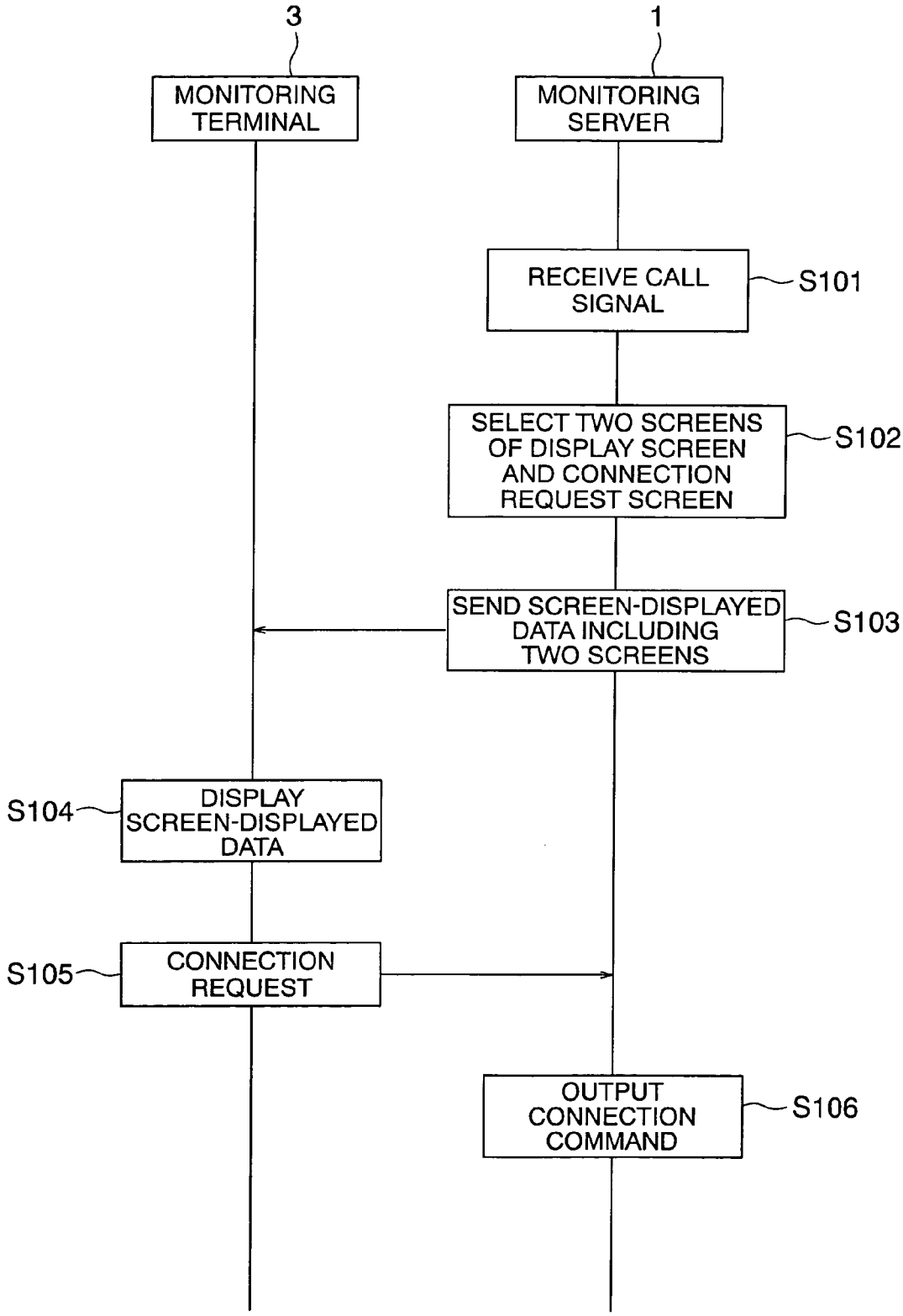
FIG. 4 is a flowchart of an operation flow of the monitoring server and monitoring terminal of FIG. 1.

FIG. 4 is a flowchart of an operation flow of the monitoring server 1 and the monitoring terminal 3. Hereinbelow, explanation will be given taking as an example the case where the display screen S2 of the monitoring information d3 in the screen-displayed data d2 sent from the monitoring server 1 is displayed on the display unit 303 of the monitoring terminal 3 in response to a request (e.g., designation of an URL) from the monitoring terminal 3. Note that the communications between the monitoring server 1 and the monitoring terminal 3 are based on a protocol such as TCP/IP (Transmission Control Protocol) or HTTP (Hyper Text Transfer Protocol), for example.

For example, when a passenger in the car 6 of the first elevator depresses the call button 9, the communication path selecting device 11 outputs a call signal indicating this situation to the monitoring server 1 via the Ethernet 2. Then, the processing unit 103 of the monitoring server 1 receives the call signal (S101), references the storage unit 102, and selects the display screen S1 of the image data d1 and the connection request screen S3. In this example, selected are the display screen S1 of the image data d1 indicative of the condition in the car 6 of the first elevator, and the connection request screen S3 for issuing a request to connect communication lines between the interphone unit 8 in the car 6 of the first elevator and the interphone unit 13 in the monitor room (S102). The processing unit 103 reads the screen-displayed data d2 including the two screens S1 and S3 from the storage unit 102, and sends the screen-displayed data d2 to the monitoring terminal 3 via the Ethernet 2 (S103).

The processing unit 305 of the monitoring terminal 3 receives the screen-displayed data d2 from the monitoring server 1 and stores the received data in the storage unit 304, and the screen-displayed data d2 read from the storage unit 304 is displayed on the display unit 303 (S104).

Figure 5:
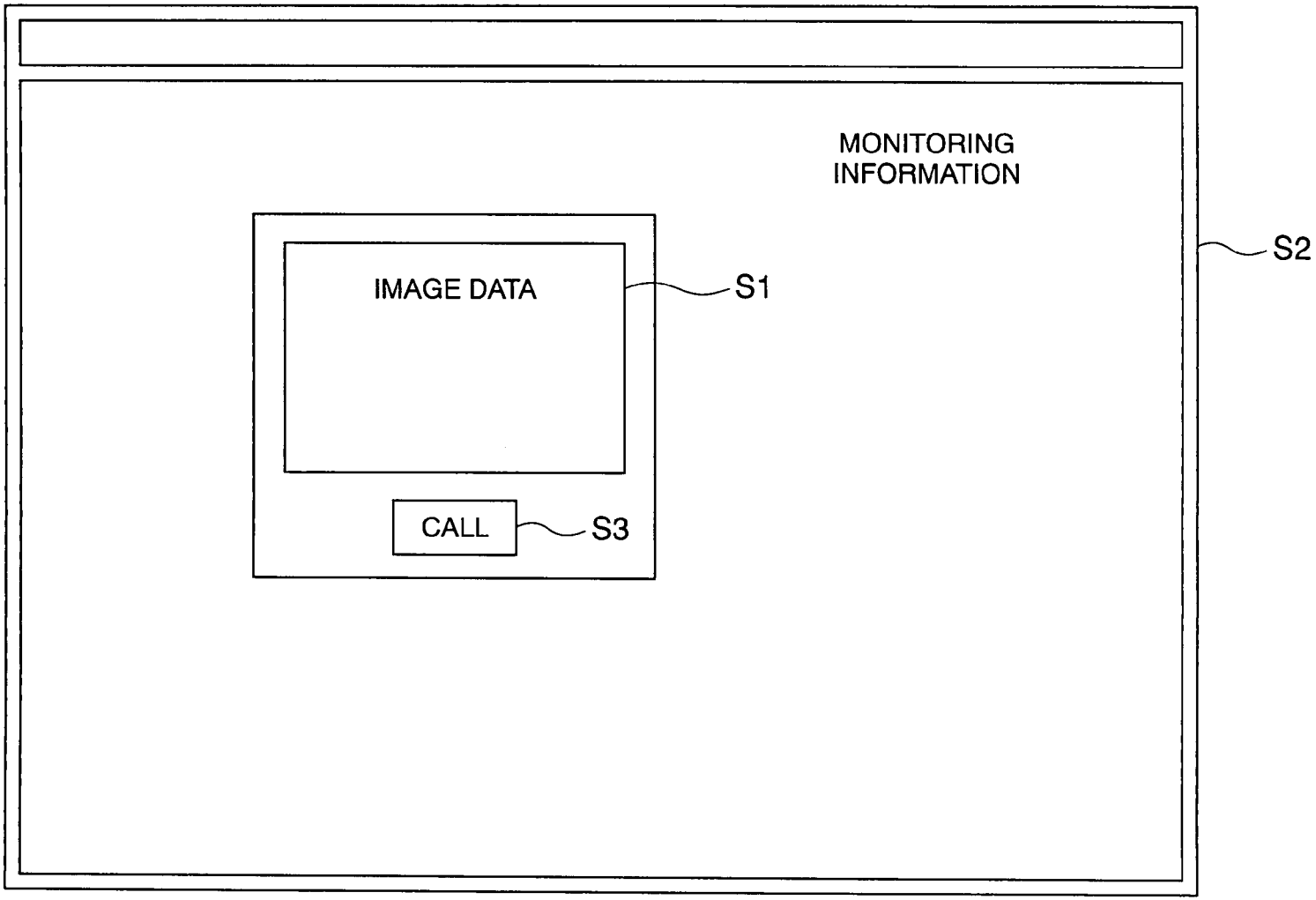
FIG. 5 illustrates a screen displayed on the monitoring terminal of FIG. 1.

FIG. 5 shows the screen-displayed data d2 displayed on the display unit 303. In FIG. 5, the display screen S1 of the image data d1 and the connection request screen S3 are displayed on the display unit 303 besides the display screen S2 of the monitoring information d3. The observer can thus grasp the operation of the car 6 of the first elevator by checking the display screen S2 or the condition in the car 6 of the first elevator by checking the display screen S1. Further, the observer can confirm that a passenger calls the interphone unit 13 by checking the connection request screen S3.

Then, the observer operates the monitoring terminal 3 to execute an operation (e.g., clicking) on the connection request screen S3 on the display unit 303. In response thereto, the monitoring terminal 3 issues a connection request corresponding to the connection request screen S3 to the monitoring server 1 via the Ethernet (S105).

The processing unit 103 of the monitoring server 1 then issues a connection command corresponding to the connection request from the monitoring terminal 3 to the communication path selecting device 11 via the Ethernet 2. The connection command is a command for giving an instruction to connect lines between the interphone unit 8 of the first elevator and the interphone unit 13 in the monitor room, and is read from a predetermined area in the storage unit 102 (S106).

Receiving the connection command from the monitoring server 1, the LAN interface 11*b* of the communication path selecting device 11 drives the relay circuit 11*a* between the interphone unit 8 of the first elevator and the interphone unit 13 in the monitor room. The relay circuit connects lines between the interphone unit 8 of the first elevator and the interphone unit 13 in the monitor room. As a result, the observer can directly talk with a passenger in the car 6 of the first elevator.

As described above, the monitoring server 1 of the first embodiment references the storage unit 102, and sends to the monitoring terminal 3 via the Ethernet 2 the screen-displayed data d2 with any of the plural monitor-related screens being selectively incorporated therein, in response to the instruction from the external devices 3 and 1 (reception of the request from the monitoring terminal 3 and the call signal from the communication path selecting device 11). Thus, the monitoring server 1 can provide the monitoring terminal 3 with a predetermined monitor-related screen in the screen-displayed data d2 together with the screen-displayed data d2. This realizes the efficient elevator monitoring operation.

In addition, the monitoring terminal 3 displays the plural monitor-related screens in the screen-displayed data d2 read from the storage unit 304 on the display unit 303. Thus, the plural monitor-related screens can be displayed in a single window form on the display unit 303. Accordingly, the observer or the like can collectively and concurrently perform various operations for monitoring an elevator operation on the monitoring terminal 3. Therefore, the elevator monitoring operation can be efficiently performed.

In addition, the display screen S1 of the image data d1, the display screen S2 of the monitoring information d3, and the connection request screen S3 are set as the monitor-related screens. Therefore, it is possible to simultaneously perform an operation of displaying the image data d1, an operation of displaying the monitoring information d3, and an operation on the connection request screen S3, on the monitoring terminal 3. Thus, the elevator monitoring operation can be performed with higher efficiency.

The call button 9 being depressed, the monitoring terminal 3 receives the screen-displayed data d2 including the display screen S1 of the image data d1 and the connection request screen S3 from the monitoring server 1, and displays the received one on the display unit 303. Thus, when the call button 9 is depressed, the observer or the like can check the condition in the car 6 furnished with the call button 9 on the monitoring terminal 3 or make an instruction to connect lines between the car 6 and the monitor room through the monitoring terminal 3. As a result, the observer or the like can appropriately deal with an emergency in the car 6, for example.

Note that in the first embodiment, the description is directed to the case where the monitoring server 1 receives the call signal from the communication path selecting device 11 and sends the screen-displayed data d2 including the two screens S1 and S3 to the monitoring terminal 3. However, the present invention is not limited thereto. For example, the monitoring server 1 may send the screen-displayed data d2 including the three screens d1 to d3 to the monitoring terminal 3.

SECOND EMBODIMENT

Figure 6:
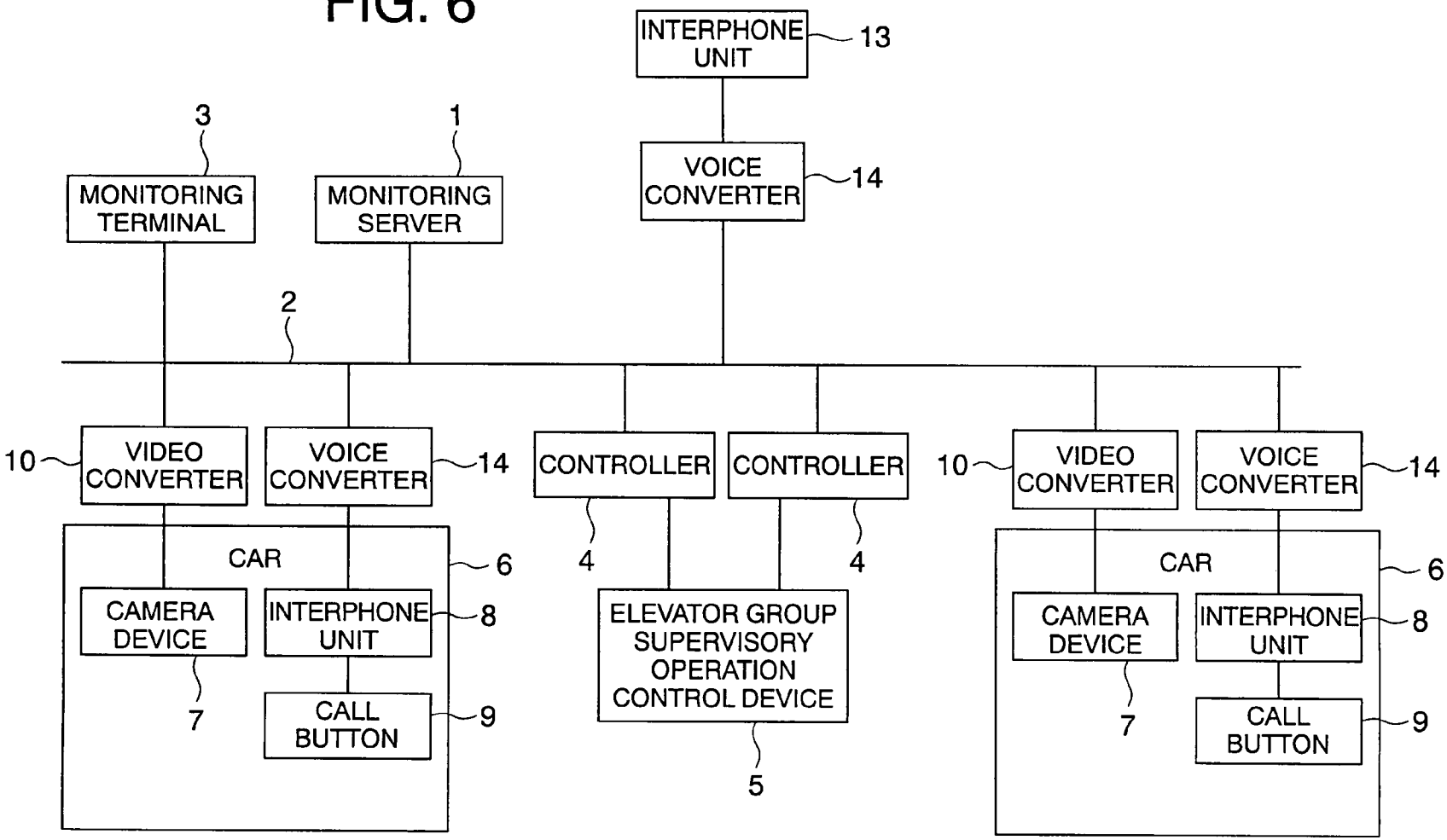
FIG. 6 is a diagram showing a configuration of an elevator monitoring system according to a second embodiment of the present invention.

FIG. 6 is a diagram showing a configuration of an elevator monitoring system according to a second embodiment. Note that the same components as in the first embodiment are denoted by like reference numerals, and any repetitive description is omitted here.

In FIG. 6, the interphone units 8 and 13 are each connected to the Ethernet 2 through a voice converter 14. The voice converter 14 converts voice from the interphone units 8 and 13 into digital signals conforming to the specifications of the Ethernet 2.

When the monitoring terminal 3 issues a request to connect communication lines between the interphone unit 8 of the first elevator and the interphone unit 13 to the monitoring server 1, for example, in response to any operation made on the connection request screen S3 displayed on the display unit 303, the monitoring server 1 executes the following processing. That is, the monitoring server 1 outputs a signal instructing each voice converter 14 corresponding to the connection request from the monitoring terminal 3 to start conversion into digital signals. This allows communications between the car 6 of the first elevator and the monitor room via the Ethernet 2.

Accordingly, in the second embodiment as well, when the call button 9 is depressed, talking voice from the interphone units 8 and 13 is converted into digital signals by each voice converter 14, enabling communications between the car 6 and the monitor room via the Ethernet 2. Based on the above, there is an advantage in that a communication line 12 and the communication path selecting device 11 can be dispensed with.

Note that in the description of the first and second embodiments, the monitoring server 1 and the monitoring terminal 3 are separately provided. However, they may be integrated into a single device such that the monitoring terminal 3 may be given the function of the monitoring server 1, for example.

Also, the monitoring server 1 may send the screen-displayed data d2 created by arbitrarily combining the three screens S1 to S3 to the monitoring terminal 3 in response to requests from the monitoring terminal 3.

The invention claimed is:

1. An elevator monitoring terminal, comprising:

a storage unit storing screen-displayed data including a plurality of monitor-related screens related to an elevator monitoring operation; and a processing unit for displaying the plurality of monitor-related screens in the screen-displayed data read from the storage unit on a display unit, wherein the plurality of monitor-related screens comprise a display screen of monitoring information regarding an operation of an elevator, a display screen of image data indicative of an in-car condition, and a connection request screen for issuing a request to connect communication lines between a car interphone unit and a monitoring-room interphone unit.

2. The elevator monitoring terminal according to claim 1, wherein the processing unit displays the screen-displayed data including the display screen of the image data and the connection request screen on the display unit when a call button provided inside the car is depressed.

3. The elevator monitoring terminal according to claim 2, wherein, when the processing unit issues the request to connect the communication lines, to an elevator monitoring apparatus, based on an operation made on the connection request screen, via a communication network, communication between the car interphone unit and the monitoring-room interphone unit can be made via the communication network by converting talking voices into digital signals.

4. An elevator monitoring apparatus, comprising:

a storage unit storing screen-displayed data including a plurality of monitor-related screens related to an elevator monitoring operation; and a processing unit for selectively incorporating any one of the plurality of monitor-related screens into the screen-displayed data and sending the screen-displayed data to a monitoring terminal via a communication network in response to an instruction from an external device, wherein the plurality of monitor-related screens comprise a display screen of monitoring information regarding an operation of an elevator, a display screen of image data indicative of an in-car condition, and a connection request screen for issuing a request to connect communication lines between a car interphone unit and a monitoring-room interphone unit.

* * * * *